US010264832B2

(12) United States Patent
Gibbons

(10) Patent No.: US 10,264,832 B2
(45) Date of Patent: Apr. 23, 2019

(54) NURSING COVER

(71) Applicant: The Boppy Company, LLC, Golden, CO (US)

(72) Inventor: Haley Gibbons, Westminster, CO (US)

(73) Assignee: The Boppy Company, LLC, Golden, CO (US)

( * ) Notice: Subject to any disclaimer, the term of this patent is extended or adjusted under 35 U.S.C. 154(b) by 357 days.

(21) Appl. No.: 14/986,567

(22) Filed: Dec. 31, 2015

(65) Prior Publication Data

US 2016/0227847 A1 Aug. 11, 2016

Related U.S. Application Data

(60) Provisional application No. 62/113,765, filed on Feb. 9, 2015.

(51) Int. Cl.

| | |
|---|---|
| ***A41D 27/28*** | (2006.01) |
| ***A41D 15/00*** | (2006.01) |
| ***A41D 3/08*** | (2006.01) |
| ***A41D 23/00*** | (2006.01) |
| ***A41D 1/18*** | (2006.01) |
| ***A41D 31/00*** | (2019.01) |
| ***A41D 1/215*** | (2018.01) |

(52) U.S. Cl.

CPC ..... *A41D 15/00* (2013.01); *A41D 1/18* (2013.01); *A41D 1/215* (2018.01); *A41D 3/08* (2013.01); *A41D 23/00* (2013.01); *A41D 27/28* (2013.01); *A41D 31/00* (2013.01)

(58) Field of Classification Search

CPC ..... A41D 1/22; A41D 1/204; A41D 1/20

See application file for complete search history.

(56) References Cited

U.S. PATENT DOCUMENTS

| | | | | | |
|---|---|---|---|---|---|
| 4,528,699 | A | * | 7/1985 | Hughes | A41D 1/215 2/104 |
| D306,510 | S | * | 3/1990 | Sanchez | D2/728 |
| 4,987,612 | A | * | 1/1991 | Middleton | A41D 1/215 2/104 |
| 5,034,999 | A | * | 7/1991 | Lubbers | A41D 1/215 2/104 |

(Continued)

FOREIGN PATENT DOCUMENTS

| | | | | | |
|---|---|---|---|---|---|
| CA | 2280454 | A1 | * | 2/2001 | A41D 1/215 |
| WO | WO 2011019991 | A2 | * | 2/2011 | A41D 23/00 |

OTHER PUBLICATIONS

"Bebe au Lait Hooter Hiders Nursing Cover," Bebe au Lait, LLC, accessed on Jan. 4, 2016, 2 pages. Retrieved from www.bebeaulait.com.

(Continued)

*Primary Examiner* — Richale Quinn

(74) *Attorney, Agent, or Firm* — Kilpatrick Townsend & Stockton

(57) ABSTRACT

A multi-way wearable nursing cover, including a cover body having a top end and a bottom end. The cover body may be flexible and is configured to conceal a user's chest when worn while nursing a baby. A strap attaches to the top end of the cover body, wherein at least one of a first end and a second end of the strap is operably attached to the top end. A see-through portion also couples to the cover body, wherein the see-through portion enables a user to see the baby while nursing.

19 Claims, 5 Drawing Sheets

(56) References Cited

U.S. PATENT DOCUMENTS 5,038,411 A * 8/1991 St. Armand ..... A41D 1/215 2/104
5,259,068 A * 11/1993 Carroll ..... A41D 1/205 2/104
5,469,582 A * 11/1995 Livingston ..... A41D 1/215 2/104
5,479,662 A * 1/1996 Runco ..... A41D 1/215 2/104
5,544,364 A * 8/1996 Weber ..... A41D 1/215 2/104
5,652,958 A * 8/1997 Farrell-Mestas ..... A41D 1/215 2/48
5,652,960 A * 8/1997 Kaknevicius ..... A41D 1/215 2/104
D405,940 S * 2/1999 Payne ..... D2/860
5,956,762 A * 9/1999 Adams ..... A41D 1/215 2/48
7,114,191 B1 * 10/2006 Butler-Penenberg ..... A41D 1/205 2/104
7,207,070 B1 * 4/2007 Swarez-Ballesteros ..... A41D 1/215 2/104
D542,509 S * 5/2007 Campbell ..... D2/728
7,444,684 B1 * 11/2008 Medina ..... A41D 1/215 2/48
7,490,362 B2 * 2/2009 Owen ..... A41D 1/215 2/104
9,003,565 B1 * 4/2015 Leach ..... A41D 1/205 2/104
9,101,169 B1 * 8/2015 Leach ..... A41D 1/205
D752,847 S * 4/2016 Sandoval ..... D2/860
9,380,815 B2 * 7/2016 Toro-Gerstein ..... A41D 1/215
2007/0094764 A1 * 5/2007 Wakefield ..... A41D 1/215 2/104
2007/0214549 A1 * 9/2007 Carr ..... A41F 15/002 2/312
2011/0252535 A1 * 10/2011 McNeil ..... A45D 44/08 2/50
2012/0131723 A1 * 5/2012 Greenwood ..... A41D 23/00 2/104
2012/0151657 A1 * 6/2012 Gibbons ..... A41D 1/215 2/104
2012/0284893 A1 * 11/2012 Sohn ..... A41D 1/215 2/46
2013/0326794 A1 * 12/2013 Ortiz ..... A41D 27/00 2/243.1
2013/0326795 A1 * 12/2013 Ortiz ..... A41D 15/00 2/243.1
2014/0317827 A1 * 10/2014 Isler ..... A41B 13/06 2/69.5
2014/0338096 A1 11/2014 Ekelund

OTHER PUBLICATIONS

"Bebe au Lait Nursing Cover," Bebe au Lait, LLC, accessed on Jan. 4, 2016, 11 pages. Retrieved from www.bebeaulait.com.
"Born Free Bliss™ Nursing Shawl," Born Free Holdings Ltd., acquired by Summer Infant in 2011, accessed on Jan. 4, 2016, 2 pages. Retrieved from www.newbornfree.com.
"Hold Me Close Nursing Scarf," Sondra Hinnenkamp, accessed on Jan. 4, 2016, 3 pages. Retrieved from www.holdmeclose.net.
"InfinityMOM Nursing Scarf," Kaite Johnson, accessed on Jan. 4, 2016, 1 page. Retrieved from http://www.infinitymomstyle.net/.
"Itzy Ritzy Nursing Happens Infinity Breast Feeding Scarf," Itzy Ritzy, accessed on Jan. 4, 2016, 1 page. Retrieved from www.itzyritzy.com.
"NüRoo Nursing Cover Scarf," NüRoo, Inc., accessed on Jan. 4, 2016, 2 pages. Retrieved from http://nuroobaby.com.
"OrganicKidz (Baby & Me) Nursing Cover", OrganicKidz, accessed on Jan. 4, 2016, 1 page. Retrieved from www.organickidz.ca.
"The Peanutshell® Nursing Cover," Goo-go Style, Inc., accessed on Jan. 4, 2016, 1 page. Retrieved from www.thepeanutshell.com.
"Trend Lab Nursing Cover," Trend Lab, LLC, accessed on Jan. 4, 2016, 6 pages. Retrieved from www.trend-lab.com.
"Balboa Baby® Nursing Cover," Balboa & Baby Co., LLC, accessed on Jan. 4, 2016, __ pages. Retrieved from www.balboababy.com.
"Bamboobies Chic Nursing Shawl", Soft Style, Inc., accessed on Jan. 4, 2016, 2 pages. Retrieved from www.buybamboobies.com.

* cited by examiner

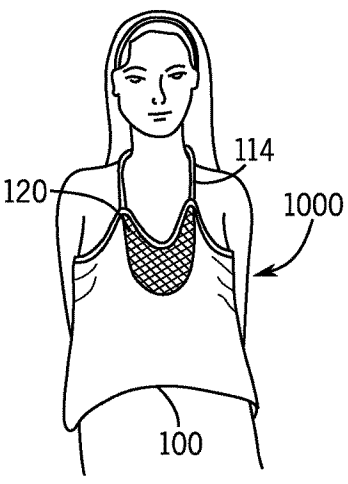
FIG. 7A
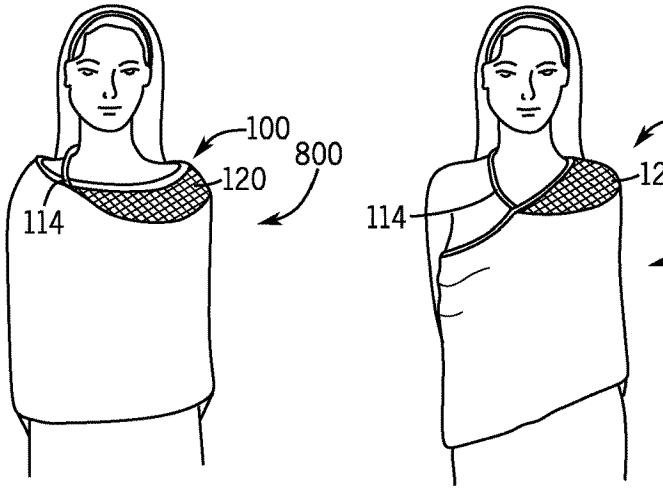
FIG. 8A
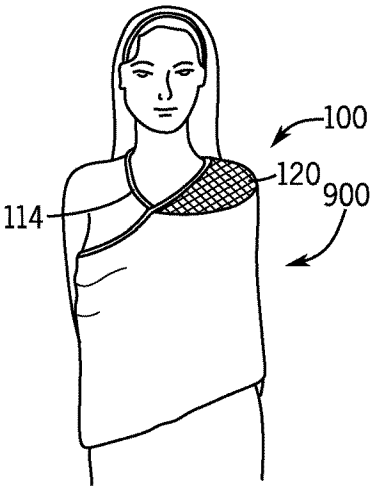
FIG. 9A
FIG. 10A
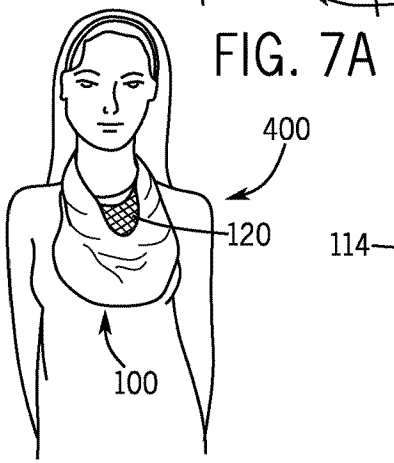
FIG. 7B
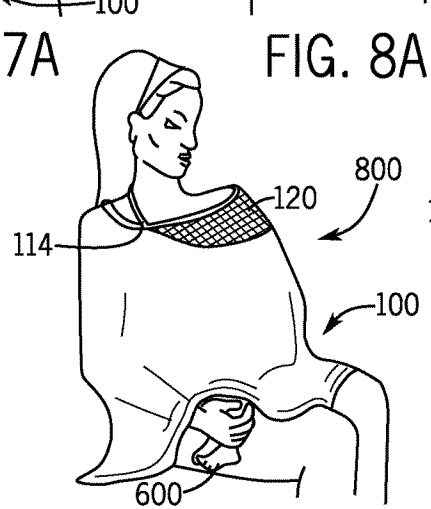
FIG. 8B
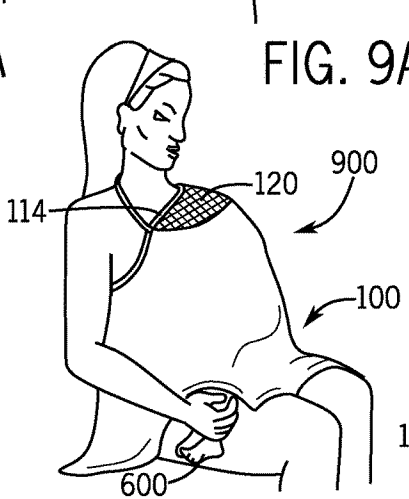
FIG. 9B
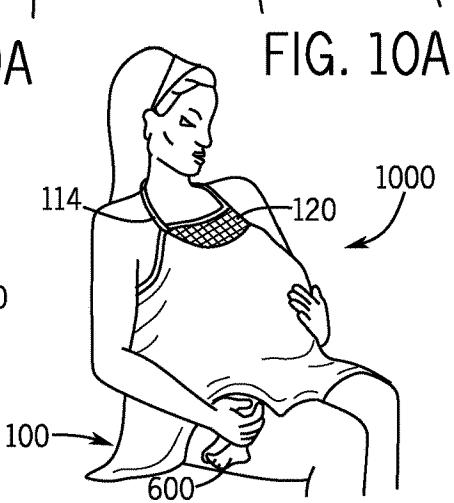
FIG. 10B

NURSING COVER

CROSS-REFERENCE TO RELATED APPLICATIONS

This application claims the benefit of and priority to U.S. Provisional application No. 62/113,765, titled "SHAWL WITH INTEGRATED NURSING COVER," filed on Feb. 9, 2015, which is incorporated by reference herein in its entirety.

BACKGROUND OF THE INVENTION

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Nursing mothers may use nursing covers for privacy while feeding their infants in public places and in the company of others. For example, a mother may use a nursing cover to cover her chest and the infant to block unwanted exposure while nursing. However, at times the mother may want to view the infant during feeding. To do so, the mother may have to lift the nursing cover away from her chest in order to see the infant. In some situations, moving the nursing cover to see the infant may undesirably expose the infant and/or the mother's chest.

BRIEF SUMMARY OF THE INVENTION

The present disclosure is directed to a multi-way wearable nursing cover that includes a cover body having a top end and a bottom end. The cover body may be flexible and configured to conceal a user's chest when worn while nursing a baby. The nursing cover may include a strap attached to the top end of the cover body with a first end and a second end. The nursing cover may include a see-through portion extending along at least a portion of the cover body. The see-through portion may be flexible and sheer to permit a user to see the baby while nursing.

Various embodiments of the multi-way wearable nursing cover may include one or more of the following features. The flexible cover body may be opaque. The see-through portion may be at least one of a translucent and a transparent material. The first end of the strap may be permanently attached to the top end of the cover body, and the second end of the strap may be removably attached to the cover body. For example, the second end of the strap may be removably attached to the cover body with a snap closure or button closure; hook and loop fastener; a securing loop formed with a securing ring, etc.

The multi-way wearable nursing cover may also include additional features. For example, the multi-way wearable nursing cover may be transformed into a variety of configurations such as a scarf, a halter top, a two-shoulder cover-up/cape, and a one-shoulder cover-up/cape. The see-through portion of the multi-way wearable nursing cover may include a thin sheet of mesh fabric that promotes airflow. The see-through portion may also be sewn to the cover body. The cover body may include a sheet of material that forms a closed loop, which enables the cover body to drape and encircle a user when worn. For example, the cover body may include a sheet of fabric having opposing ends that are sewn together to define a seam. In some embodiments, the cover body may be generally cone-shaped between a top edge/end and a bottom edge/end. In other words, the cover body may be angled between the top edge and the bottom edge. The outer circumference may define a bottom end and the inner circumference may define a top end. In some instances, the outer circumference may be greater than the inner circumference. The top end of the cover body may define an opening for receiving a user's head, and the bottom end may include an elastic band.

BRIEF DESCRIPTION OF THE DRAWINGS

Various features, aspects, and advantages of the present invention will be better understood when the following detailed description is read with reference to the accompanying figures in which like characters represent like parts throughout the figures, wherein:

FIG. 7A is a front view of an embodiment of a nursing cover in a scarf configuration;

FIG. 7B is a front view of an embodiment of a nursing cover in a scarf configuration;

FIG. 8A is a front view of an embodiment of a nursing cover in a two-shoulder cover-up/cape configuration;

FIG. 8B is a perspective view of the nursing cover in FIG. 8A being used as a nursing cover;

FIG. 9A is a front view of an embodiment of a nursing cover in a one-shoulder cover-up/cape configuration;

FIG. 9B is a perspective view of the nursing cover in FIG. 9A being used as a nursing cover;

FIG. 10A is a front view of an embodiment of a nursing cover in a shirt/halter top configuration; and FIG. 10B is a perspective view of an embodiment of the nursing cover in FIG. 10A being used as a nursing cover.

DETAILED DESCRIPTION OF THE INVENTION

Figure 1:
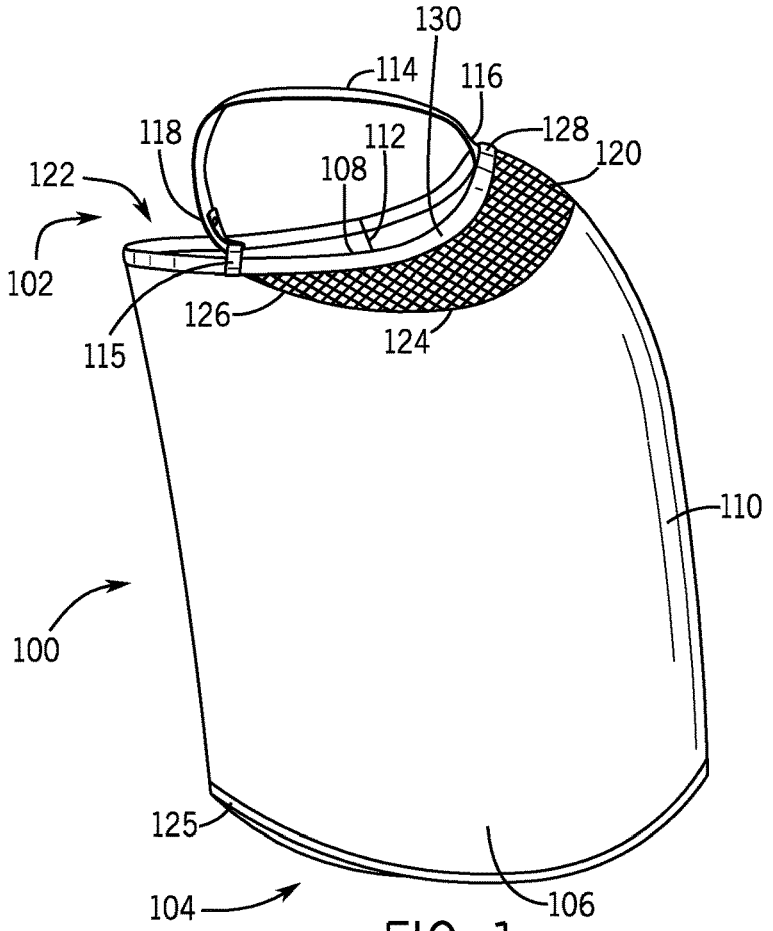
FIG. 1 is a front perspective view of an embodiment of a nursing cover.

One or more specific embodiments of the present invention will be described below. These embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with systemrelated and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

In general, the embodiments disclosed below include a multi-use nursing cover that includes a see-through portion that enables a user (e.g., nursing mother) to view and/or make eye contact with a baby while nursing. The see-through portion may be a sheer material, transparent material, semi-transparent material, mesh, etc. that enables a user to see through the nursing cover. As will be explained in detail below, the nursing cover may serve purposes other than as a nursing cover by enabling the user to change configurations. For example, the nursing cover may be transformed or reconfigured by a user into a scarf; a shirt; a tank top; a two-shoulder cape or cover-up; and/or a one-shoulder cape or cover-up. In some embodiments, there may additional configurations (e.g., head wrap, turban). All of these configurations are in addition to the nursing cover being used as a nursing cover.

In practice, the nursing cover may facilitate nursing and provide privacy for the nursing mother. The nursing cover may permit visualization and eye contact between the mother and the feeding infant without requiring further maneuvering of the nursing cover for viewing. For instance, the mother may simply look downwardly through the see-through portion to view the infant without having to reposition or otherwise move portions of the nursing cover out of the way. The convenience of the see-through portion may enhance or increase opportunities to make eye contact and/or see the infant. The see-through portion may also improve airflow through the nursing cover to aid in regulating temperature in the immediate nursing environment.

The nursing cover may be draped or otherwise worn by the mother in a variety of ways to maximize comfort and satisfy a variety of personal preferences/styles. Further, the nursing cover may offer diverse configurations that are useful for multiple purposes including applications other than nursing. Merely by way of example, the nursing cover may be converted "on the fly" or "upon demand" to a scarf, shawl, cape, fashion accessory, apparel item, wind blocker, sun blocker, weather blocker, and so on. In this way, the nursing cover may continue to be used by the mother even after the infant outgrows the need for nursing. Accordingly, the nursing cover may be fashionable as well as functional without appearing solely as a nursing cover-up. The nursing cover may be quickly converted between various configurations, which may allow the mother to easily nurse her infant in different places and settings.

FIG. 1 is a front perspective view of a nursing cover 100 that may be worn in a variety of configurations (e.g., multi-use, multi-way wearable nursing cover). The nursing cover 100 may include a flexible, stretchable, and/or foldable material that enables a user to cover some or all of a user's chest and a nursing infant during use. For convenience in referring to the drawings, the nursing cover 100 can be described as having a top end 102, a bottom end 104, a front side 106, and a backside 108 (see also FIG. 3). The nursing cover 100 may include a cover body 110 (e.g., main body portion) extending between, and/or including, the top end 102 and the bottom end 104. The cover body 110 may be tubular-shaped, cone-shaped, and/or an elongate sheet of material that is secured together permanently (e.g., sewn, riveted, etc.) or removably (e.g., buttons, zipper, etc.) along a seam 112. In some embodiments, the cover body 110 may be formed from multiple pieces of material coupled together with multiple seams 112.

To facilitate use, the nursing cover 100 may include one or more straps 114 (e.g., 1, 2, 3, 4, 5) attached to the top end 102 of the cover body 110. The strap 114 may secure the nursing cover 100 to the user's neck, to block the nursing cover 100 from sliding off the user. For example, the strap 114 may extend around the back of a user's neck to hold the nursing cover 100 in place. In some embodiments, the strap 114 may be adjustable in length by incorporating additional plastic or metal fittings 115 together (e.g., chained). For example, the fittings 115 may be a square ring, d-ring, an O-ring, or a combination thereof.

The strap 114 may include a first end 116 and a second end 118. In some embodiments, the strap 114 is permanently attached (e.g. sewn, riveted, etc.) to the nursing cover (e.g., top end 102 of the cover body 110) while an opposing second end 118 is removably attached to the nursing cover 100 (e.g., top end 102 of the cover body 110). In another embodiment, both the first and second ends 116, 118 of the strap 114 are permanently attached to the cover body 110. In still other embodiments, the first and second ends 116, 118 may be removably coupled (e.g., button, hook and loop fastener, snap fastener, etc.) to the cover body 110 to enable a user to easily replace the strap 114 with other straps 114 that have different styles and/or enable the user to use the nursing cover 100 without the strap 114. The strap 114 may be constructed of one or more materials (e.g., fabric, plastic, metal, leather, etc.) that may be the same as and/or different from the material of the cover body 110.

As illustrated, the nursing cover 100 may include a see-through portion 120 that extends along at least a portion of the top end 102 of the cover body 110. The see-through portion 120 enables a user to see through the nursing cover 100. The see-through portion 120 extends along the front side 106 of the cover body 110 and is sized to permit the user to view the baby without risking unwanted exposure. The see-through portion 120 may include a sheer, translucent, and/or transparent material (e.g., mesh fabric, netting, plastic sheet, etc.). In some examples, the see-through portion 120 may be constructed from a material that is thinner than the material of the cover body 110. The see-through portion 120 may be sewn or otherwise permanently attached to the cover body 110 (e.g., riveted). In some embodiments, the see-through portion 120 may be removably attached (e.g., using buttons, zippers, clasps, snap fastener, etc.)

The cover body 110 may be constructed from a variety of materials that are opaque or sufficiently opaque to provide privacy during nursing. Such materials may include sheet-like materials, (e.g., fabrics such as cotton, polyester, wool, nylon, silk, denim, spandex, and elastin, among others). In one particular embodiment, a stretch jersey knit fabric may be advantageously used. For example, stretch jersey knit fabric drapes well when the nursing cover 100 is used in a scarf configuration, and easily stretches around the user when the nursing cover 100 is used while nursing. Blends of these materials may also be used, such as cotton/polyester blends. In some embodiments, the cover body 110 material(s) are breathable and lightweight to properly ventilate and block overheating of the infant and/or user. The material of the cover body 110 may also provide a desired draping effect or fit, such as a stretch-fit (e.g., using cotton/polyester blends, ribbed knitting, and/or combinations thereof, etc.). The materials may also be washable and durable to withstand repeat usage. In some embodiments, the materials selected may be windproof, and/or SPF-blocking as well.

The cover body 110 may be formed in many ways. For example, the cover body 110 may include a sheet of material that forms a closed loop, with the top end 102 forming an opening/outlet 122 that enables a user to pull the cover body 110 over their head. When worn, the cover body 110 may loosely drape and encircle the user (see FIG. 1). In some examples, the bottom end 104 may include an elastic band or pull string 125 that enables a user to cinch the bottom end 104 and block drafts while nursing. The closed loop may be formed with first and second ends of a generally rectangular-shaped sheet of fabric that are sewn together to define the seam 112, such that the closed loop is generally cylindrical in shape. However, in some embodiments the closed loop may be opened or otherwise separable by a zipper(s), or buttons, etc. In another embodiment, the cover body 110 may be formed as a loop without any seams. For example, the cover body 110 may be constructed from a single sheet of material with a cone-shaped cut, that angles from a top end 102 to a bottom end 104. In some embodiments, the bottom end 104 may be rounded, scalloped, and/or define straight corners or angles.

To assist the user in seeing the infant, the cover body 110 may include a cutout area or window 124 that accommodates the see-through portion 120. In some embodiments, the window 124 may curve upwardly towards the top end 102 to define a pair of opposing endpoints 126, 128 that meet a top band 130. The shape of the see-through portion 120 may be crescent shaped, semi-circular shaped, square shaped, rectangular shaped, irregularly shaped, etc. In some embodiments, the crescent shape may be critical in enabling a user to adequately see the infant while still preserving privacy. For example, when a nursing mother looks down, this shape permits the visualization of the baby's head while nursing. At the same time, when a bystander views the mother from the front, the crescent shape provides a minimal opening so that the mother's breasts are hidden from view. Other embodiments may have a differently shaped see-through portion 120 that enables a user to see the infant while nursing while also preventing others from seeing the infant nursing.

Figure 1A:
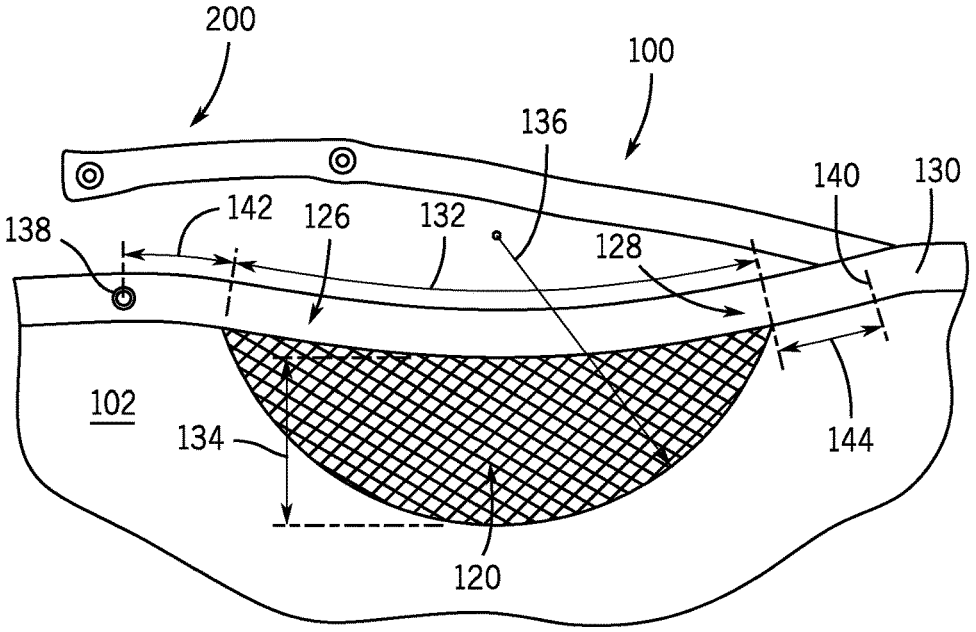
FIG. 1A is a partial view of an embodiment of a nursing cover lying flat on a surface.

FIG. 1A is a partial view of the nursing cover 100. As illustrated, the see-through portion 120 may be defined by a variety of dimensions. For example, the see-through portion 120 may have a length 132. The length 132 may in some cases be between about 5 inches to 14 inches, in other cases about 5 inches to 10 inches, in still other cases about 5 inches to 8 inches, and in some exemplary cases about 5 inches to 10 inches. In some cases, the see-through portion 120 may also be described as extending along a percentage of the entire inlet 122 or top band 130. For example, the see-through portion 120 may extend along the entire inlet 122 or top band 130 a fraction of the distance (e.g., ¼, ½, ¾, etc.) about the inlet 122. The see-through portion 120 also defines a width 134. The width 134 may be in the range from about 2 inches to 7 inches, in some cases from about 2 inches to 5 inches, in still other cases about 2 inches to 4 inches. In an exemplary embodiment, the length 132 may be approximately 10 inches and the width 134 approximately 3.5 inches. Instead of the specific lengths 132 and widths 134, the see-through portion 120 may also be described as occupying a portion of the overall surface area of the nursing cover 100. For example, the see-through portion 120 may occupy about 1% to 20%, in some cases about 1% to 15%, in other cases about 1% to 10%, and in some exemplary cases about 1% to 5% of the overall surface area of the nursing cover 100. In some embodiments, the actual surface area of the see-through portion 120 may be approximately 18-65 square inches. In an exemplary embodiment, the surface area may be approximately 35 square inches. Such dimensions maximize the visualization to the user, but prevent visualization of the nursing baby by bystanders.

As explained above, the see-through portion 120 may have a specific shape (e.g., semi-circular, crescent shaped). If the see-through portion 120 has a rounded shape, the see-through portion 120 may have a radius of curvature 136. The radius of curvature 136 may be about 2 inches to 8 inches, in some cases about 2 inches to 6 inches, and in other cases about 2 inches to 5 inches. In an exemplary embodiment, the radius of curvature 136 may be approximately 5 inches.

In some embodiments, the see-through portion 120 may be located between attachment points 138, 140 such that distances 142, 144 exist between respective endpoints/edges 126, 128 of the see-through portion 120 and the attachment points 138, 140 of the strap 114. The distances 142 and 144 may be equal to one another or different. In some embodiments, the distances 142, 144 may be in the range from about 1 inch to about 5 inches, in other cases about 5 inches to about 3 inches. In an exemplary embodiment, the distances 142 and 144 may be approximately 2.25 inches. Such positioning assists in maximizing visualization to the nursing mother while minimizing visualization of the baby by bystanders.

Figure 2:
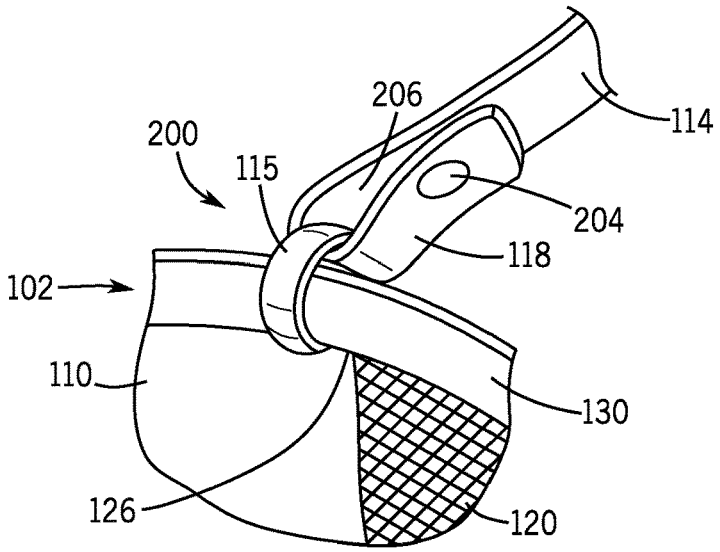
FIG. 2 is a partial perspective view of a securing mechanism attached to the nursing cover in FIG. 1.

FIG. 2 is a close-up view of a securing or attachment mechanism 200 for the strap 114 shown in FIG. 1. The attachment mechanism 200 includes a fitting/securing ring 115 coupled to the top band 130. As illustrated, the second end 118 of the strap 114 extends through the fitting 115. After extending through the fitting 115, the second end 118 of the strap 114 may be fastened onto itself with a closure 204 (e.g., snap or button closure), to form a securing loop 206. As shown in FIG. 2, the attachment mechanism 200 may be provided at or near an end portion/end point 126 of the see-through portion 120 to avoid interference with the see-through portion 120; however, other variations are possible. In some embodiments, the attachment mechanism 200 couples next to or to the cover body 110 for structural benefits (e.g., cover body may be a thicker and/or from a more durable material). It should be understood that first and/or second ends 116,118 of the strap 114 may include the attachment mechanism 200.

The attachment mechanism 200 may also be another type of attachment mechanism, such as hook and loop fasteners, buttons, snaps, ties, clips, clasps, single rings, or a tie between the strap 114 and another strap, etc. In some embodiments, the attachment mechanism 200 and/or any other portion of the nursing cover 100 may be capable of removably attaching other items thereto, such as electronics, music players, toys, clips, burp cloths, pacifiers, hanging pockets, and/or pouches.

In some embodiments, the second end 118 of the strap 114 may couple directly to the cover body 110. For example, the second end 118 of the strap 114 may be sewn, glued, or otherwise directly attached to the cover body 110. Alternatively, the second end 118 may couple to the cover body 110 with an attachment mechanism 200 (e.g., a snap, button, hook and loop fastener material, tie, clip, or clasp, and/or a combination thereof). For example, the attachment mechanism 200 may be a clip or clasp that couples to the cover body 110. In another example, the attachment mechanism 200 may include a pair of corresponding fastenable features, such as a snap fastener having a pair of interlocking parts with one piece on the strap 114 and the corresponding piece on the cover body 110. In still another example, the securing mechanism 200 may be a button on either the strap 114 or the cover body 110 with the corresponding buttonhole on either the strap 114 or the cover body 110. In some embodiments, the strap 114 or the cover body 110 may include spaced-apart buttonholes, snap fasteners, etc. that enable variable positioning of the strap 114. For example, the snap fasteners, buttons, etc. may be 1, 2, 3, 4, or more inches apart (see FIG. 1A). In an exemplary embodiment, the buttons, snap fasteners, etc. may be 3.5 inches apart.

As explained above, the nursing cover 100 may include the top band 130. The top band 130 may reinforce the top end 102 of the nursing cover 100 and enable attachment of the cover body 110, the see-through portion 120, and the strap 114. For example, the see-through portion 120 may be sewn to the top band 130. In some embodiments, the top band 130 may be elastic, such as an elastic band. In some embodiments, the strap 114 may be slidably repositioned. For example, a user may slide the fitting 115 or another attachment (e.g., securing ring) along the top band 130 enabling a user to raise or lower the see-through portion 120 with respect to a user's neck.

Figure 3:
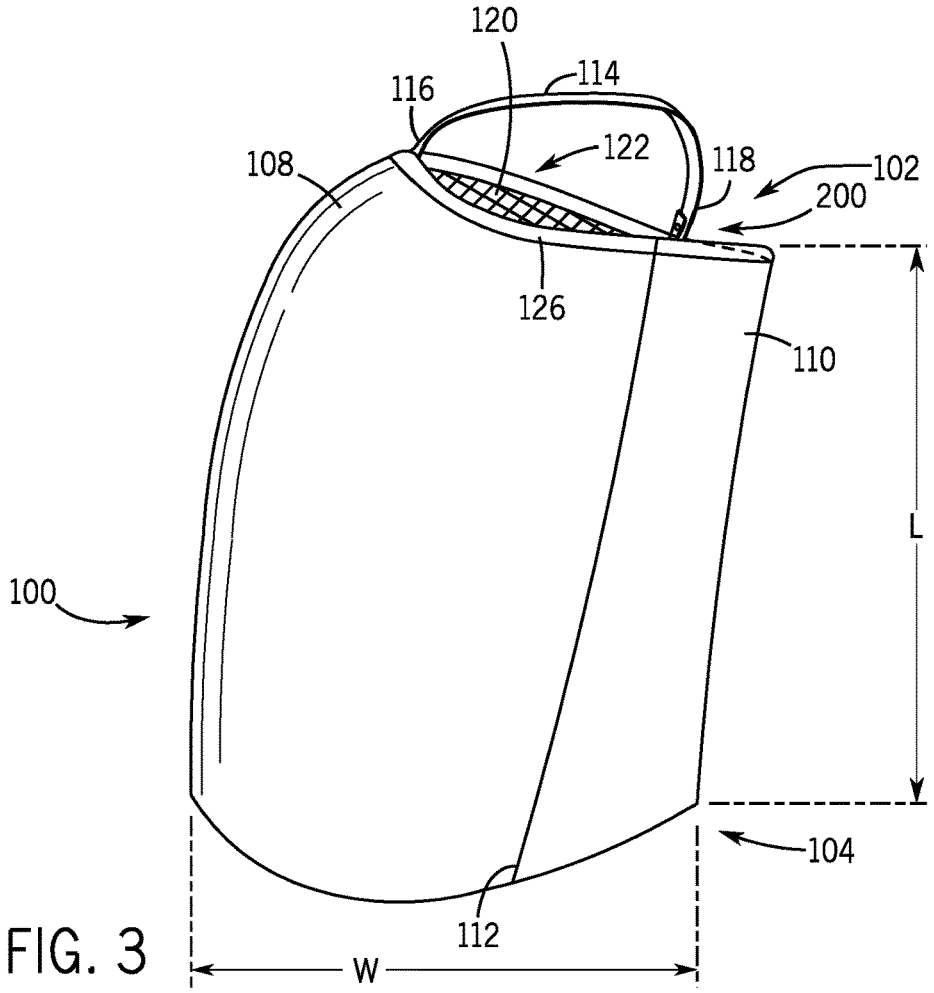
FIG. 3 is a rear perspective view of an embodiment of the nursing cover in FIG. 1.

FIG. 3 is back perspective view of the nursing cover 100 of FIG. 1. As illustrated, the see-through portion 120 may not extend to the backside 108. However, in some embodiments, the see-through portion 120 may extend all the way around the outlet 122 or substantially all the way around the outlet 122. In some embodiments, the strap 114 may generally be attached to the front side 106 of the nursing cover 100. However, in other embodiments, the strap 114 may attach at other locations and/or be repositioned about the outlet 122. As explained above, the cover body 110 may be joined at a seam 112. In some embodiments, the seam 112 may be formed using a zipper that extends along a portion of, or an entire length L of the nursing cover 100. In some embodiments, the length L of the nursing cover may be sufficiently long to extend to a user's waist, beyond the user's waist, and/or extend to the user's feet. For example, the length L may extend to a user's waist when a nursing infant is accounted for. In an exemplary embodiment, the length L may be in the range from about 25 inches to about 35 inches, in some cases from about 27 inches to 33 inches, in other cases about 28 inches to 31 inches, and in still other cases approximately 29 inches. The width W may also be sufficient to completely cover the infant or a majority of the infant. For example, the width W of the nursing cover in a flat position may be in the range from about 18 inches to about 30 inches, in other cases about 20 inches to about 28 inches, and in other cases about the width W may be 26 inches.

Figure 4:
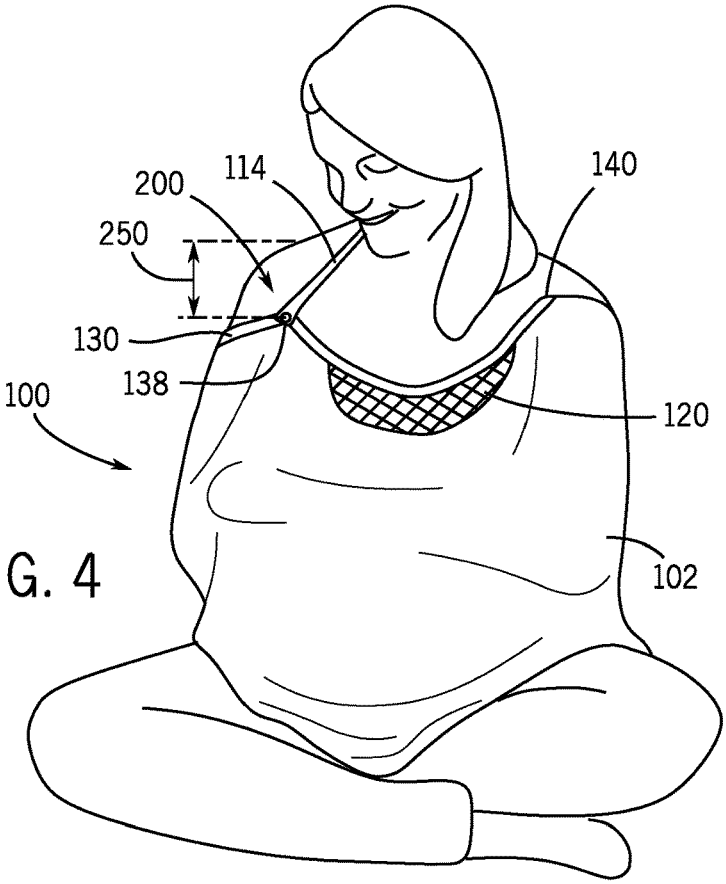
FIG. 4 is a front view of an embodiment of a user with a nursing cover.

FIG. 4 is a front view of a user with a nursing cover 100. As illustrated, during use the mother's chest is concealed when viewed from the front, while still enabling the mother to observe and/or make eye contact with the infant. As explained above, the strap 114 may be adjusted to raise and lower the see-through portion 120 with respect to a user's neck. For example, the securing mechanism 200 may include a pair of corresponding fastenable features, such as a snap fastener having a pair of interlocking parts or buttons with corresponding buttonholes. In some embodiments, the strap 114 or the cover body 110 may include a plurality of spaced-apart buttonholes, snap fasteners, etc. that enable variable positioning of the strap 114. For example, the snap fasteners, buttons, etc. may be 1, 2, 3, 4, or more inches apart (see FIG. 1A). In an exemplary embodiment, the buttons, snap fasteners, etc. may be 3.5 inches apart. The plurality of spaced-apart buttonholes, snap fasteners, etc. enable a user to position the attachment point of the nursing cover 100 a distance 250 (e.g., 1, 2, 3, 4, 5 inches) below the user's shoulder. For example, the strap 114 may have an overall length in the range from about 10 inches to about 18 inches, and in some cases about 12 inches to 16 inches, with the plurality of button/button holes or snap fasteners on the strap 114 at one-inch intervals. In operation, the user may adjust the position of the nursing cover 100 by increasing or decrease the length of the strap 114 using the securing mechanism 200 between the connection points 138, 140. In an exemplary embodiment, the length of the strap 114 between the connection points 138, 140 may be such that the distance 250 between the user's shoulder and the connection point 138 or 140 is approximately 3.5 inches.

Figure 5:
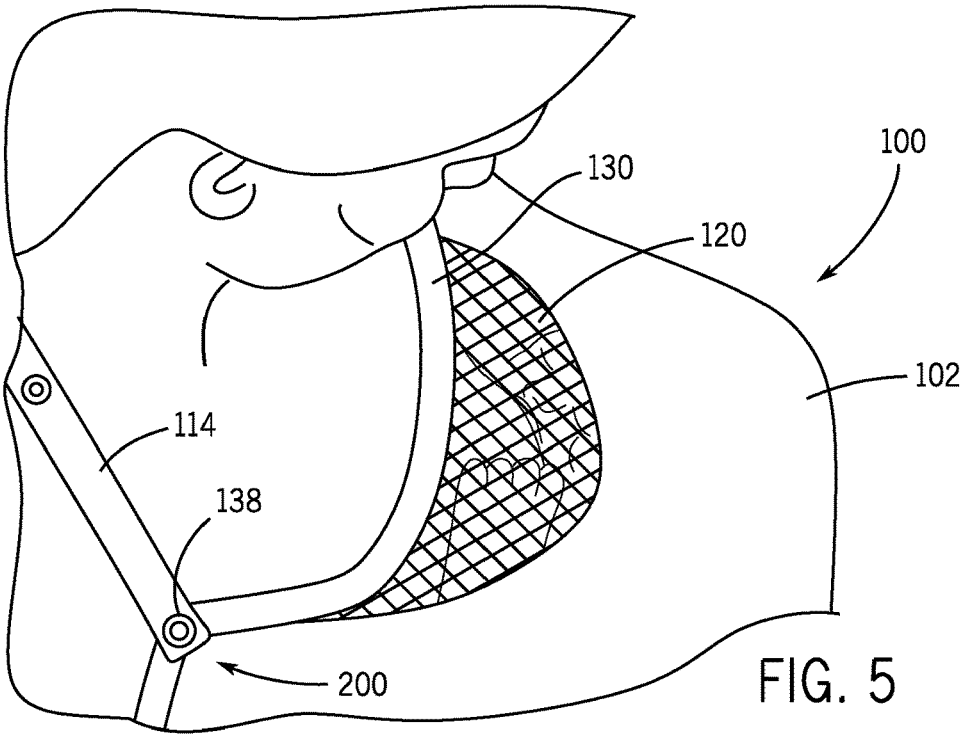
FIG. 5 is a downward looking perspective view of an embodiment of a user with a nursing cover.

FIG. 5 is a downward looking perspective view of a user with a nursing cover 100. As illustrated, the user is able to look downward and observe the infant through the see-through portion 120.

FIGS. 6-10B illustrate various configurations of the nursing cover 100 being implemented by a user. For instance, the nursing cover 100 may provide a multi-way, wearable nursing cover 105 that can be alternately transformed between a scarf, a halter top, a two-shoulder cape/cover-up, and a one-shoulder cape/cover-up, among others.

Figure 6B:
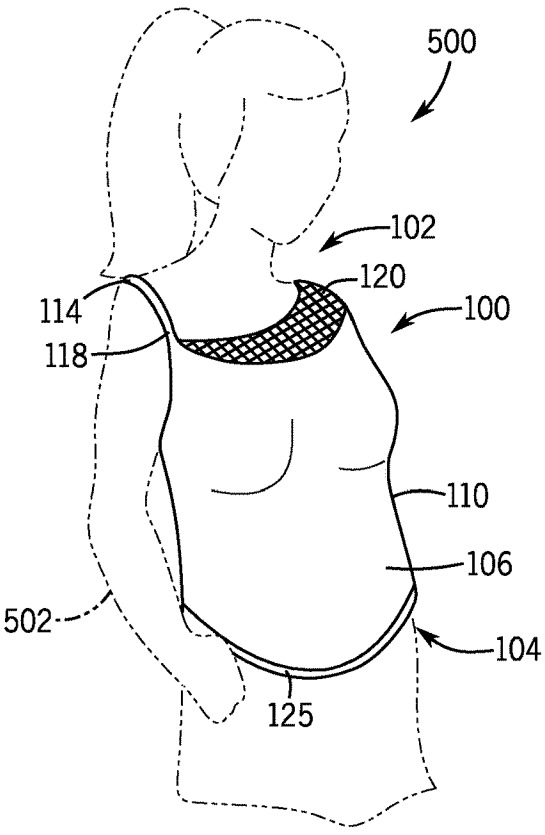
FIG. 6B is a perspective view of an embodiment of a nursing cover in a shirt/halter top configuration.
Figure 6C:
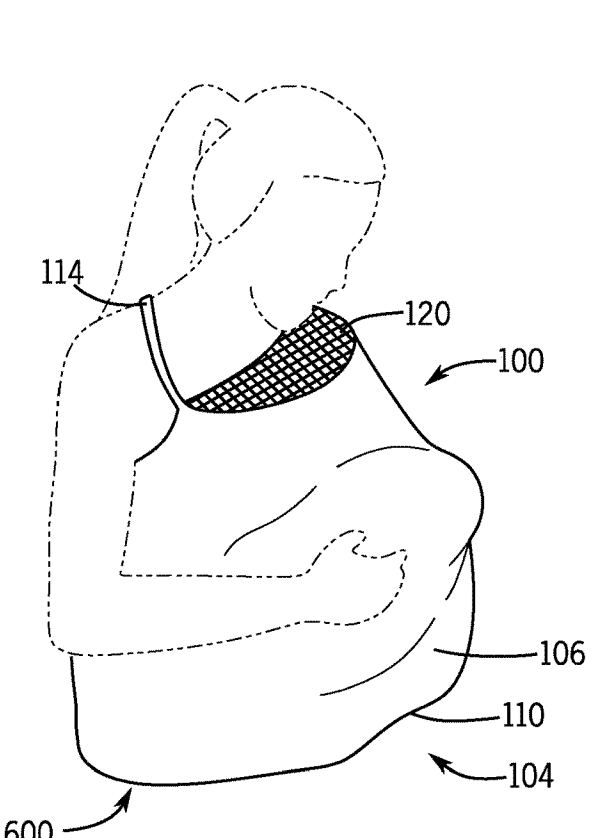
FIG. 6C is a perspective view of an embodiment of a nursing cover being used as a nursing cover.
Figure 6A:
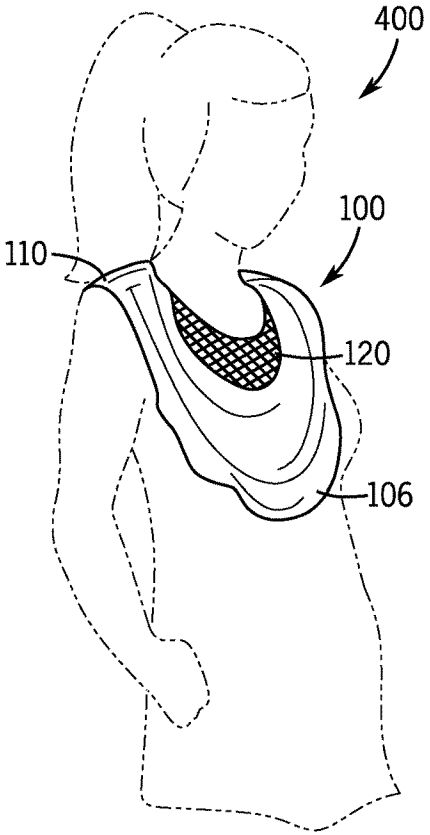
FIG. 6A is a perspective view of an embodiment of a nursing cover in a scarf configuration.

As shown in FIG. 6A, the nursing cover 100 may be configured as a scarf 400. For example, the user's head may pass through at least the top end 102 of the nursing cover 100 such that the cover body 110 may be draped across the user's shoulders. The see-through portion 120 may be front facing as shown, or rotated otherwise. Further, the see-through portion 120 and/or the cover body 110 may include patterns, textures, or other decorative/fashionable features. In some embodiments, the nursing cover 100 may be reversible to offer interchangeable colors and styles. When worn as a scarf 400, the strap 114 may be hidden from view or removed.

FIG. 6B shows the nursing cover 100 in a shirt/halter top configuration 500. As illustrated, the user's head extends through the top end 102 such that the see-through portion 120 serves as a collar. The strap 114 may be secured around the user's shoulder, whereby the second end 118 of the strap 114 may be front facing and the first end 116 of the strap 114 (hidden from view) may span across the user's back. The cover body 110 may be approximately shirt-length such that the bottom end 104 hits at approximately the user's waist. In another embodiment, the cover body 110 may extend beyond the user's waist, but may be optionally cinched around the user's waist with an elastic and/or drawstring mechanism 125. As explained above, the user may easily switch from the scarf configuration 400 to the shirt configuration 500 by sliding the user's arm 502 through the top end 102 so that the strap 114 rests on the user's shoulder and then draping the other side of the nursing cover 100 downwardly. In some cases, the nursing cover 100 may be used as a one-shoulder top.

FIG. 6C shows the nursing cover 100 used during nursing. As shown, the nursing cover 100 conceals an infant 600 while permitting the user to look downwardly through the see-through portion 120 to see the infant 600. The see-through portion 120 may provide ventilation for the infant 600, as well as enable the user to see and speak to the infant 600. In some embodiments, the nursing cover 100 may completely conceal infant 600.

FIGS. 7A-B illustrate the nursing cover 100 worn in a scarf configuration 400 (e.g., infinity scarf). The nursing cover 100 may be looped around the user's neck once as shown in FIG. 7A, and/or twice as shown in FIG. 7B. In some embodiments, the nursing cover 100 may be pulled over the back of the user's head into a hooded scarf configuration.

FIGS. 8A-B show the nursing cover 100 worn in a two-shoulder cover-up or cape configuration 800. As illustrated, the nursing cover 100 may completely drape around the user. The strap 114 may engage the user's neck to secure the nursing cover 100. In another example, the nursing cover 100 may be secured to the user by engaging the top end 102 on the user's shoulders without the strap 114. In order to transition from the scarf configuration 400 shown in FIG. 7A, the user may pull the nursing cover 100 downwardly over both shoulders to achieve the two-shoulder cape 800 as shown. The two-shoulder cape 800 enables the user to see the infant 600 through the see-through portion 120 while nursing, as shown in FIG. 8B.

FIGS. 9A-B illustrate the nursing cover 100 worn as a one-shoulder cover-up 900. To achieve the one-shoulder cover-up 900, the user may pull the scarf 400 configuration of the nursing cover 100, seen in FIG. 7A, downwardly over one shoulder and under one arm. The one-shoulder cover-up/cape may be provided with or without the strap 114. The one-shoulder cape configuration 900 likewise permits a user to see the infant 600 through the see-through portion 120 while nursing, as shown in FIG. 9B.

FIGS. 10A-B illustrate the nursing cover 100 worn as a halter cover-up or top configuration 1000. To achieve the halter cover-up configuration 1000, the user may pull the scarf configuration 400 of the nursing cover 100, seen in FIG. 7A, downwardly under both arms and use the strap 114 to hold the nursing cover 100 in place. The halter top/cover-up 1000 enables a user to see the infant 600 through the see-through portion 120 during nursing, as shown in FIG. 10B.

In summary, the nursing cover 100 provides privacy to the nursing mother and infant, as well as encouraging interaction between the mother and infant through the see-through portion 120. For instance, the see-through portion 120 enables the mother to see and/or speak to the infant at any moment during nursing without requiring the mother to reposition the nursing cover 100. Finally, the nursing cover 100 is multi-functional and provides quick and easy transitions between different configurations.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A multi-way wearable nursing cover, comprising:

a cover body comprising a closed, continuous loop of material having a top end and a bottom end, wherein the cover body is flexible and configured to conceal a user's chest when worn while nursing a baby;

a strap attached to the top end of the cover wherein the strap comprises a first end and a second end that operably couple to the top end by at least a first attachment point and a second attachment point;

a see-through portion coupled to the cover body, wherein the see-through portion enables a user to see the baby while nursing; and wherein the first attachment point is positioned on a first side of the see-through portion and the second attachment point is positioned on a second side of the see-through portion, the see-through portion extending between the first and second attachment points such that the first side of the see-through portion is spaced a first distance from the first attachment point and the second side of the see-through portion is spaced a second distance from the second attachment point.

2. The multi-way wearable nursing cover of claim 1, wherein the cover body is opaque.

3. The multi-way wearable nursing cover of claim 1, wherein the see-through portion comprises at least one of a translucent and a transparent material.

4. The multi-way wearable nursing cover of claim 1, wherein the first end of the strap is permanently attached to the cover body, and the second end of the strap is removably attached to the cover body with an attachment mechanism.

5. The multi-way wearable nursing cover of claim 1, wherein the first end and the second end of the strap are permanently attached to the cover body.

6. The multi-way wearable nursing cover of claim 1, wherein the first end and the second end of the strap are removably attached to the cover body.

7. The multi-way wearable nursing cover of claim 1, wherein the multi-way wearable nursing cover is configured to transform between a scarf, a halter top, a two-shoulder cape, and a one-shoulder cape configuration.

8. The multi-way wearable nursing cover of claim 1, wherein the see-through portion comprises a thin sheet of mesh fabric that promotes airflow.

9. The multi-way wearable nursing cover of claim 1, wherein the cover body comprises a stretch jersey knit fabric that enables the nursing cover to stretch around the user while nursing.

10. The multi-way wearable nursing cover of claim 1, wherein the top end of the cover body defines an opening for receiving a user's head therethrough.

11. The multi-way wearable nursing cover of claim 1, wherein the bottom end comprises an elastic band.

12. The multi-way wearable nursing cover of claim 1, wherein the cover body is generally cone-shaped and angles between a top end and a bottom end.

13. The multi-way wearable nursing cover of claim 12, wherein the top end has a first circumference that is less than a second circumference of the bottom end.

14. The multi-way wearable nursing cover of claim 1, wherein at least one of the first end and second end of the strap include an attachment mechanism that couples to the cover body.

15. The multi-way wearable nursing cover of claim 14, wherein the attachment mechanism is at least one of a snap closure; a hook and loop fastener; and a securing loop formed with a securing ring.

16. A multi-way wearable nursing cover, comprising:

a cover body having a top end and a bottom end, wherein the body cover is configured as an infinity loop of flexible material and configured to conceal a user's chest when worn while nursing;

a see-through portion coupled to the body cover at the top end, which is parallel with the top end, and configured to enable the user to see a baby positioned entirely under the body cover between the top and bottom ends while nursing; and a strap coupled with the top end of the body cover by at least a first attachment point and a second attachment point, wherein a first end of the strap attaches to the first attachment point and the second end of the strap attaches to the second attachment point.

17. The multi-way wearable nursing cover of claim 16, wherein the first end of the strap is permanently attached to the first attachment and the second end of the strap is removably attached to the second attachment point by an attachment mechanism.

18. The multi-way wearable nursing cover of 16, wherein the first end of the strap is removably attached to the first attachment point by an attachment mechanism and the second end of the strap is removably attached to the second attachment point by another attachment mechanism.

19. The multi-way wearable nursing cover of 16, wherein the multi-way wearable nursing cover is configured to transform between a scarf, a halter top, a two-shoulder cape, and a one-shoulder cape configuration.

* * * * *